US006402151B1

(12) United States Patent
Forrester et al.

(10) Patent No.: US 6,402,151 B1
(45) Date of Patent: Jun. 11, 2002

(54) TWELVE-SIDED POLYGON TILE GAME AND METHOD OF PLAYING

(76) Inventors: Kent Forrester, 2302 Westview Dr., Silver Spring, MD (US) 20910; Charles Butler, 11348 Cherry Hill Rd., #302, Beltsville, MD (US) 20705

( * ) Notice: Subject to any disclaimer, the term of this patent is extended or adjusted under 35 U.S.C. 154(b) by 1 day.

(21) Appl. No.: 09/621,287

(22) Filed: Jul. 20, 2000

Related U.S. Application Data

(60) Provisional application No. 60/145,945, filed on Jul. 28, 1999.

(51) Int. Cl.[7] ..... A63F 1/02

(52) U.S. Cl. ..... 273/293; 273/294; 273/304; 273/157 R

(58) Field of Search ..... 273/294, 293, 273/307, 287, 157 R, 271

(56) References Cited

U.S. PATENT DOCUMENTS 214,048 A * 4/1879 Mact
4,146,235 A * 3/1979 Brautovich
D444,182 S * 6/2001 Tompkins

* cited by examiner

*Primary Examiner*—Paul T. Sewell
*Assistant Examiner*—Nini Legesse
(74) *Attorney, Agent, or Firm*—Piper Rudnick LLP; Wilburn L. Chesser

(57) ABSTRACT

A game, referred to as Dazzle, that is played with flat, twelve-sided regular polygon tiles. The tiles are radially divisible by segments from the center point to the corners of the external sides into six sections—two sections encompassing one external edge, two encompassing two external edges, and two encompassing three external edges. By arrangement of these different-shaped "wedges" five tile types are generated. Three different colors, textures, or other unifying property different tiles are used with further constraints to produce a basic set. The game is played by a player selecting a tile from a pool. The first player then places the tile in the playing area, and is awarded a pre-set number of points. Subsequent players in turn select a tile from the pool and play it on the playing area. Tiles are placed so that the sides of adjacent tiles-match evenly. Unifying properties of placed tiles, such as the color of one side, must match at least one unifying property of an adjacent side of a pre-played tile. Points are awarded for the number of contiguous subsections formed among the placed tiles, and bonus points are awarded for such events as the enclosure of empty spaces. Play continues until all tiles are used, and the player with highest point accumulation is the winner.

19 Claims, 7 Drawing Sheets

TWELVE-SIDED POLYGON TILE GAME AND METHOD OF PLAYING

This application claims priority to applicants' copending U.S. Provisional Patent Application Serial No. 60/145,945 of Kent FORRESTER et al. titled "TWELVE-SIDED POLYGON TILE GAME AND METHOD OF PLAYING" filed Jul. 28, 1999.

FIELD OF THE INVENTION

This invention relates to a game played with tiles and method of playing thereof, and in particular to a game played using twelve-sided polygon tiles.

BACKGROUND

There are games known involving the sequential play by players of tiles, which are generally square or rectangular, to match elements shown on the tiles such as Dominoes and Mahjong. Games are also known which use tiles having six or eight sides.

Games are not known that involve play with many sided tiles, such as twelve-sided tiles using colored sectors.

SUMMARY OF THE INVENTION

It is an advantage of the invention to provide a game using many sided tiles, such as twelve-sided polygon tiles having multicolored sectors.

The present invention comprises a game, referred to as "Dazzle," that is played with tiles. In an embodiment of the present invention, the tiles are flat, 12-sided (dodecagonal) regular polygons, radially divided by segments from the center point to the corners of the external sides into six sections—two sections encompassing one external edge, two encompassing two external edges, and two encompassing three external edges. By arrangement of these different-shaped "wedges", five possible shape combinations are generated. By using three different colors, textures, or some other unifying property, and by requiring that similar sized portions of each tile be of the same unifying property, thirty different tiles are produced, which comprise a basic set according to one embodiment of the invention. By changing the requirements, but maintaining three unifying properties, further combinations may be obtained. In an embodiment of the present invention, two to six players may play the game.

Play begins, according to an embodiment of the present invention, with a player selecting a tile from a pool. The first player then places the tile in the playing area, and is awarded a pre-set number of points. Subsequent players in turn select a tile from the pool and play it on the playing area. Tiles must be placed in such a manner so that full sides of adjacent tiles match evenly. Unifying properties of placed tiles must match at least one unifying property of an adjacent, pre-played tile.

Points are awarded for the number of sides of the newly-played tile which match the adjacent sides on the pre-played tiles. Bonus points are awarded for the enclosure of empty spaces under certain conditions. Bonus points are awarded for enclosing an empty space with all the edges adjacent to the empty space having the same unifying property, or all edges adjacent to the empty space having different unifying properties. Play continues until all tiles are used, and the player with highest point accumulation is the winner.

To achieve the stated and other advantages of the present invention, as embodied and described below, the invention includes a method for playing a game using plurality of tiles and a playing surface, each of the plurality of tiles having a plurality of edges, wherein each of the plurality of tiles is divisible into subsections, wherein each subsection includes one of the plurality of edges, wherein each tile includes three pairs of grouped subsections, each of the pairs of grouped sections including at least one subsection, the method comprising: placing a first tile from the plurality of tiles onto the playing surface; placing a second tile from the plurality of tiles onto the playing surface, wherein the second tile is placed such that one edge of the second tile is adjacent to one edge of the first tile, the one edge of the second tile matching the one edge of the first tile; and sequentially placing each of the remaining tiles from the plurality of tiles onto the playing surface, each of the remaining tiles being placed such that at least one edge of each of the remaining tiles as placed is adjacent to at least one edge of at least one of the placed tiles, and such that at least one of the at least one adjacent edge of each of the remaining tiles matches at least one adjacent edge of at least one of the placed tiles; wherein each of the plurality of tiles is of a uniform shape, the shape including the plurality of sides; wherein the tiles are only placeable adjacent to one another.

To achieve the stated and other advantages of the present invention, as embodied and described below, the invention further includes a set of tiles for playing a tile game, wherein each tile of the set of tiles has a plurality of sides, wherein play of the game includes placement of a first tile on a playing surface and sequential placement of tiles on the playing surface, such that each sequentially placed tile is adjacent to at least one previously placed tile, and such that at least one side of each placed tile matches at least one side of at least one previously placed tile, each tile of the set of tiles comprising: a twelve sided polygon shaped wafer having a center point; the wafer being divisible into twelve triangular subsections; wherein each triangular subsection is defined by one of the twelve sides and the center point; wherein each triangular subsection has a colored surface; and each colored surface having one of three colors, such that each tile is comprised of twelve colored surface subsections, at least one of the twelve colored surface subsections being a first color, at least one of the twelve colored surface subsections being a second color, and at least one of the twelve colored surface sections being a third color.

Additional advantages and novel features of the invention will be set forth in part in the description that follows, and in part will become more apparent to those skilled in the art upon examination of the following or upon learning by practice of the invention.

DETAILED DESCRIPTION

The present invention comprises a game, referred to as "Dazzle", which is played by two or more players using play pieces that are flat tiles, the tiles and play being described further below.

Figure 1:
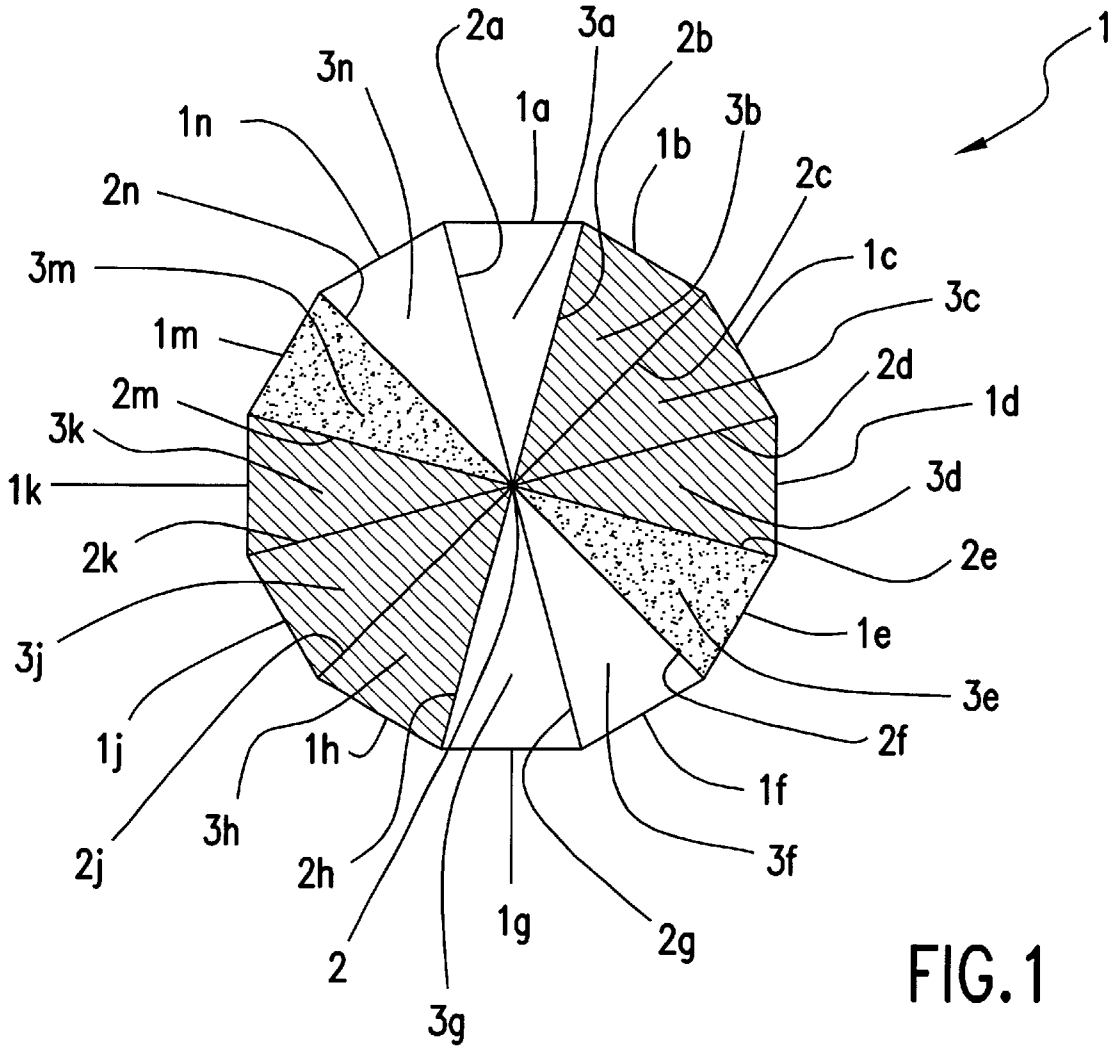
FIG. 1 depicts a twelve-sided polygon shaped tile for use in play of a game in accordance with an embodiment of the present invention.

An important aspect of the game, which allows limiting and expanding the playing piece tile set, is the size and design of the tiles. As shown in FIG. 1, in one embodiment of the present invention, the tiles, which are generally flat "wafers" (i.e., thin thickness in height), are each regular polygons 1 of twelve sides—all the sides are the same length, so that all the outer edge sides 1*a,* 1*b,* 1*c,* 1*d,* 1*e,* 1*f,* 1*g,* 1*h,* 1*j,* 1*k,* 1*m,* 1*n* and all the angles between the outer edge sides 1*a,* 1*b,* 1*c,* 1*d,* 1*e,* 1*f,* 1*g,* 1*h,* 1*j,* 1*k,* 1*m,* 1*n* for each piece are the same. Each twelve-sided tile 1 is divisible from the center point 2 radially, such that lines 2*a,* 2*b,* 2*c,* 2*d,* 2*e,* 2*f,* 2*g,* 2*h,* 2*j,* 2*k,* 2*m,* 2*n* extending from the center point to the corners divide the tile resulting in twelve triangular shaped subsections 3*a,* 3*b,* 3*c,* 3*d,* 3*e,* 3*f,* 3*g,* 3*h,* 3*j,* 3*k,* 3*m,* 3*n,* since there is one subsection per side.

One characteristic of twelve-sided tiles is that, when joining tiles at their edges, the tiles may not be joined such that an area is completely covered with tiles; no matter how the tiles are laid down adjacent to each other, openings between tiles must form. In contrast, in many existing art tile games, such as Dominoes, the tiles may be laid edge to edge completely covering a playing surface. This characteristic of twelve-sided tiles is important to how the game of Dazzle is played. Fewer or additional sided tiles may be used for play, according to additional embodiments, so long as the tiles cannot fit together such that no space appears between closed areas of adjoining tiles.

As further shown in FIG. 1, each tile is further selectively subdivided into six sections of differing sizes, each of the subdivided sections consisting of one or more of the twelve triangular shaped subsections grouped together and differentiated using, for example, different colors for each group. In addition, in order to restrict the number of tiles created for a set to 30 tiles for the base set, each tile includes three pairs of subsections, with no two subsections of the same color being adjacent. Thus, each tile includes, for example, a pair of single section groups of a first color, a pair of two section groups of a second color, and a pair of three section groups of a third color.

The tile shown in FIG. 1 includes a first white two subsection group 3*a,* 3*n;* a second white two subsection group 3*f,* 3*g;* a first black one subsection group 3*e;* a second black one section group 3*m;* a first shaded three subsection group 3*b,* 3*c,* 3*d;* and a second shaded three subsection group 3*h,* 3*j,* 3*k.* Other differentiators than colors can include, for example, texture for blind players, different materials, or different heights among the grouped sections.

By using the combination of three different pairs of sizes of subsection groups per tile, and a combination of three colors, wherein each pair (of one triangle, two triangle, and three triangle groups) is of the same color, as well as the constraint that no two adjacent section groups can be of the same color, a total of thirty different tiles are constructed, forming a single gaming set in accordance with one embodiment of the present invention. Removing any of these constraints allows for much larger combinations and larger tile sets, in accordance with additional embodiments of the present invention.

Play of the game proceeds as follows. In one embodiment, the tiles are initially laid face down and selected one at a time at random by players to play the game. In another embodiment, the tiles may initially be placed face up. Placing the tiles face up provides additional challenge to the players by allowing for strategic blocking and other strategies.

A first player draws (selects) a first tile (example tile 1, as shown in FIG. 1; note that any tile may be selected from the full set of tiles), and places the tile 1 on a playing field, such as a card table or special playing surface for use in conjunction with the present invention. The initial player is alotted an automatic numerical score for the placement of the first tile 1. In one embodiment of the present invention, the initial alotted score is eight points. In an embodiment of the present invention, the initial allotted score is varied depending on the number of players participating in the game.

A second player draws a second tile (see example tile 5 in FIG. 2), and places the tile 2 on the playing field such that one of the twelve-sided edges 5*a* of the second tile 5 contacts one of the twelve-sided edges 1*k* of the initially placed tile 1. In accordance with an embodiment of the present invention, the subsection triangles 3*k,* 7*a* corresponding to only one each of the contacting edges 1*k,* 5*a* for each tile 1, 5 must match, such as have the same color. It is not necessary that the contacting edges have the same sized subsection groups (e.g., in FIG. 2, the shaded subsection group for the first tile 1 includes three subsection triangles 3*h,* 3*j,* 3*k,* while the shaded subsection group for the second tile 5 includes two subsection triangles 7*a,* 7*b*).

Figure 2:
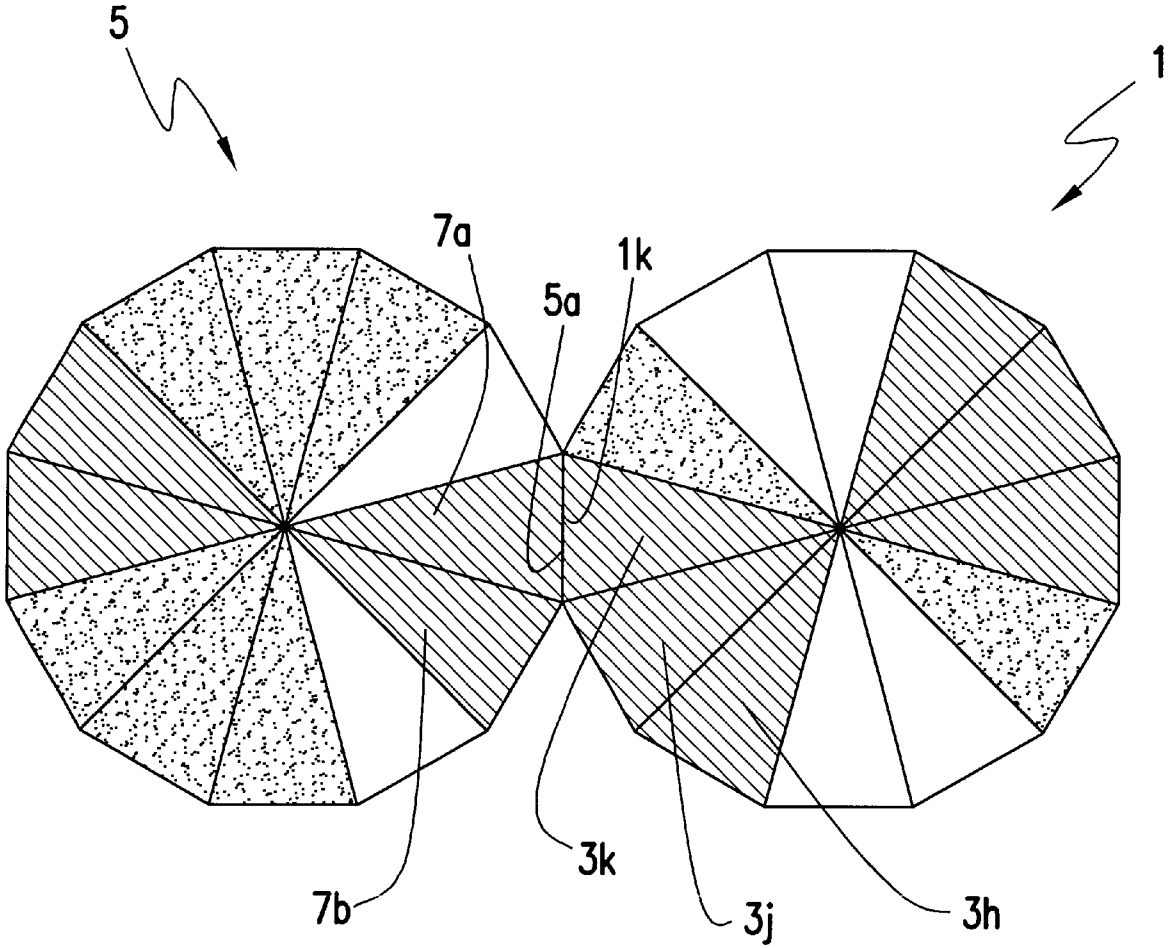
FIG. 2 presents the twelve-sided polygon shaped tile of FIG. 1 and a second tile placed adjacent to the first tile in accordance with play of the game of an embodiment of the present invention.

The score for the second player is then calculated by counting the total number of contiguous subsections of the same color formed as a result of the placement of the second tile 5. For example, as shown in FIG. 2, the first tile 1 has a shaded three subsection group 3*h,* 3*j,* 3*k,* which is contiguous with a shaded two subsection group 7*a,* 7*b,* resulting in the total contiguous number of shaded sections being five—three from the first tile 1 and two from the second tile 5, giving the second player a total of five points.

Figure 3:
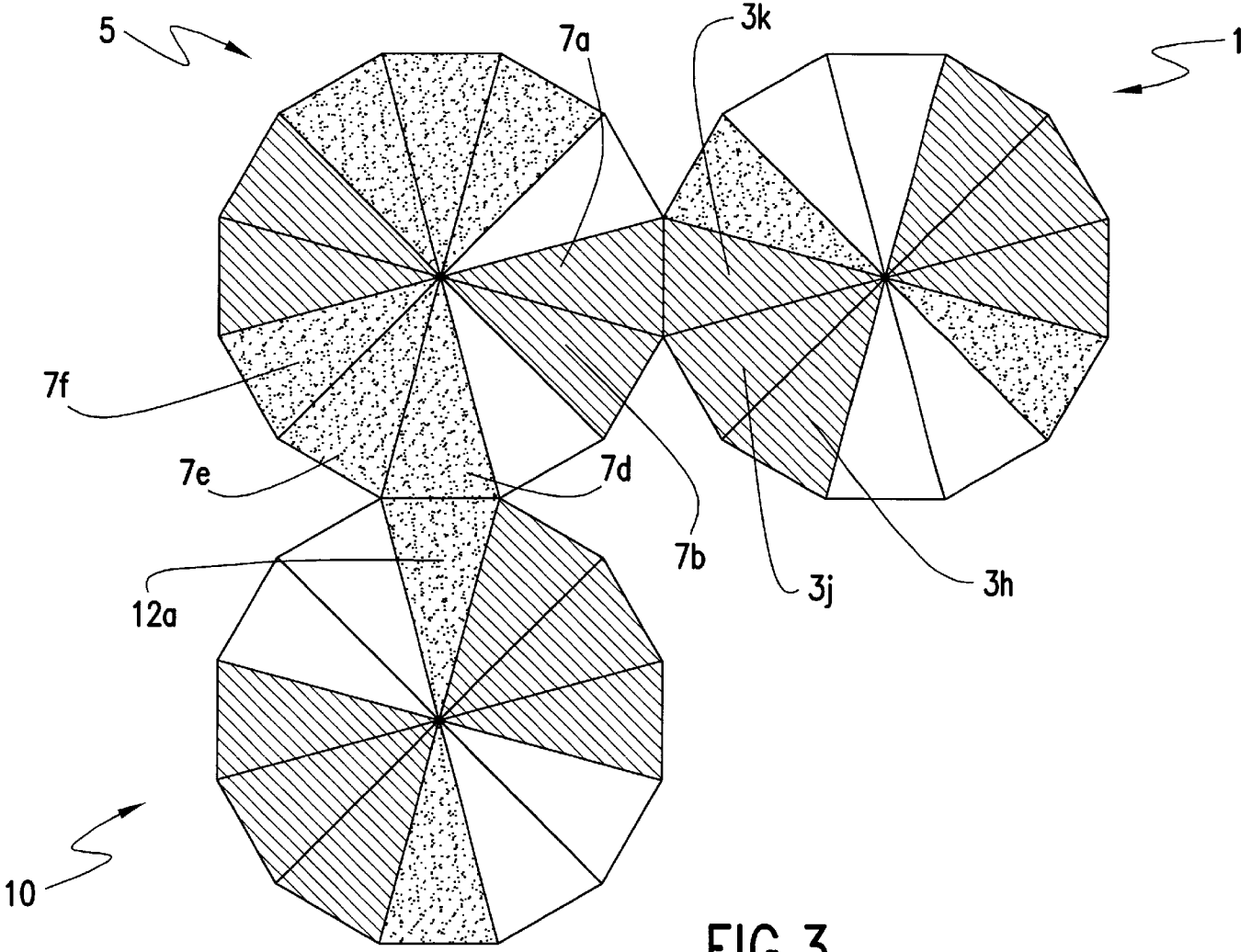
FIG. 3 shows the tiles of FIG. 2 and a third tile placed adjacent to the first tile in accordance with play of the game of an embodiment of the present invention.

Play continues in the same manner for subsequent players. For example, if a third player places a third tile 10 adjacent the second tile 5, as shown in FIG. 3, the third player receives a score of four points for the contiguous black sections 7*d,* 7*e,* 7*f* on tile 5 and section 12*a* on tile 10. Note that the player does not receive a score for contiguous sections 3*h,* 3*j,* 3*k* on tile 1 and 7*a,* 7*b* on tile 5 already formed from the first two players' placements because these contiguous sections were not formed or extended as a result of the third player's placement of the third tile 10.

In an embodiment of the present invention, play continues until all tiles are exhausted. In an embodiment of the present invention, in order to equalize play, a match consists of a plurality of games, the number of games corresponding to the number of players. A game in a match is completed upon the exhausting of all of the tiles by the playing players. Scores for the game are tallied, and the next game is played until the match is complete. The player with the highest total score for the match is the winner.

Figure 4:
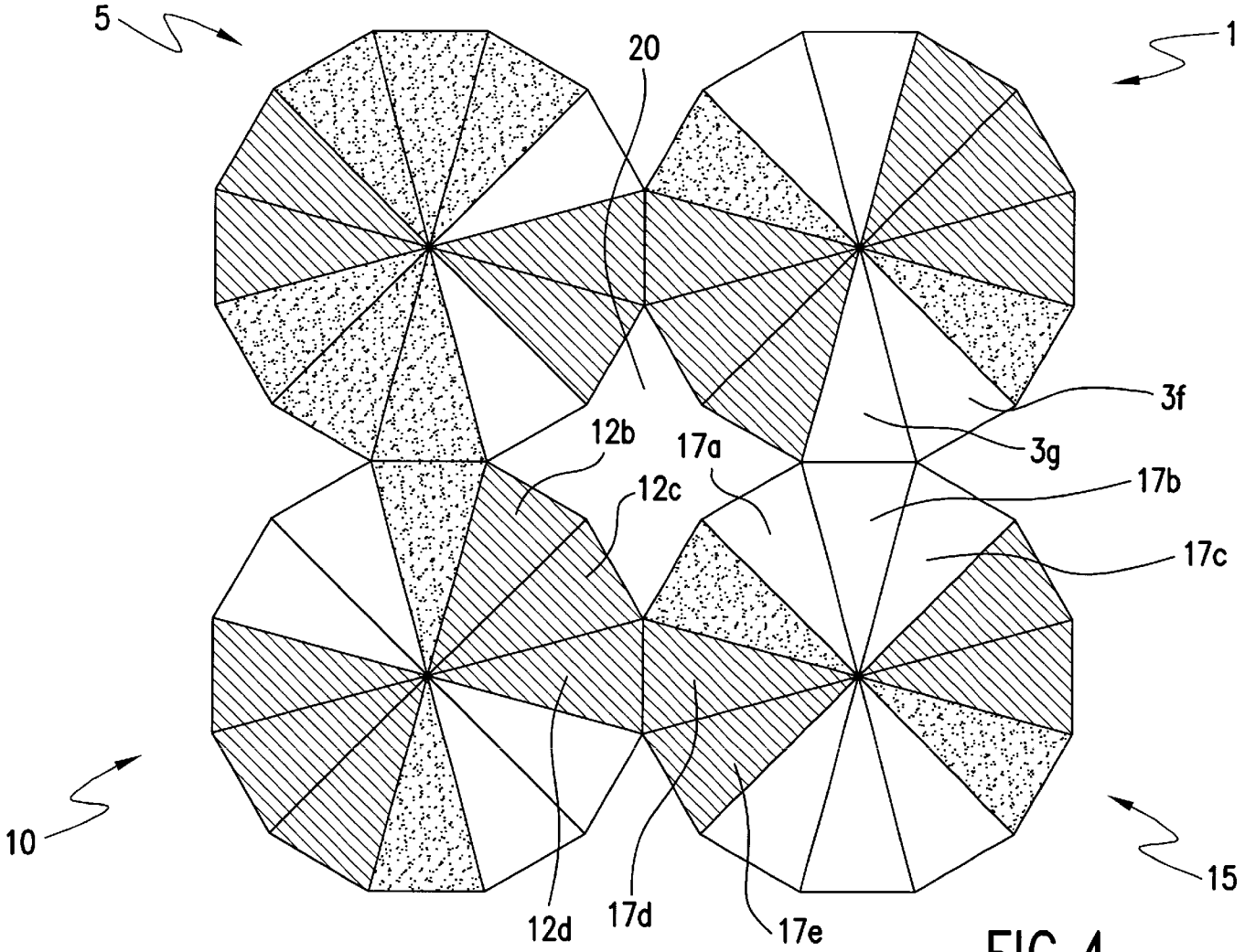
FIG. 4 depicts the three tiles of FIG. 3 and a forth tile placed adjacent to the second and third tiles in accordance with play of the game of an embodiment of the present invention.

FIG. 4 presents the appearance of the tiles 1, 5, 10, 15 after the play of a fourth player playing the fourth tile 15.

The fourth player scores nine points by creating the contiguous white areas from subsections 3*f,* 3*g* on tile 1 and subsections 17*a,* 17*b,* 17*c* on tile 15, and by creating the contiguous shaded areas from subsections 17*d,* 17*e* on tile 15 and subsections 12*b,* 12*c,* 12*d* on tile 10. Note that it was not necessary that the newly placed tile 15 match sections on both the adjacent tiles 1, 10. For example, if the white subsection 17*b* were shaded instead of white, the fourth player could still make the play, producing the contiguous shaded subsections 12*b,* 12*c,* 12*d* on tile 10 and subsections 17*d,* 17*e* on tile 15, but would simply not score the points for the contiguous white sections in that case. Also note that the four tiles 1, 5, 10, 15 by the players' placement have enclosed a star-shaped area 20.

The enclosure of open areas can result in additional scoring in accordance with an embodiment of the present invention. The enclosed area scoring, however, only occurs upon the enclosed area being surrounded by subsections of either: 1) all the same type (e.g., color); or 2) all of differing types.

Figure 5:
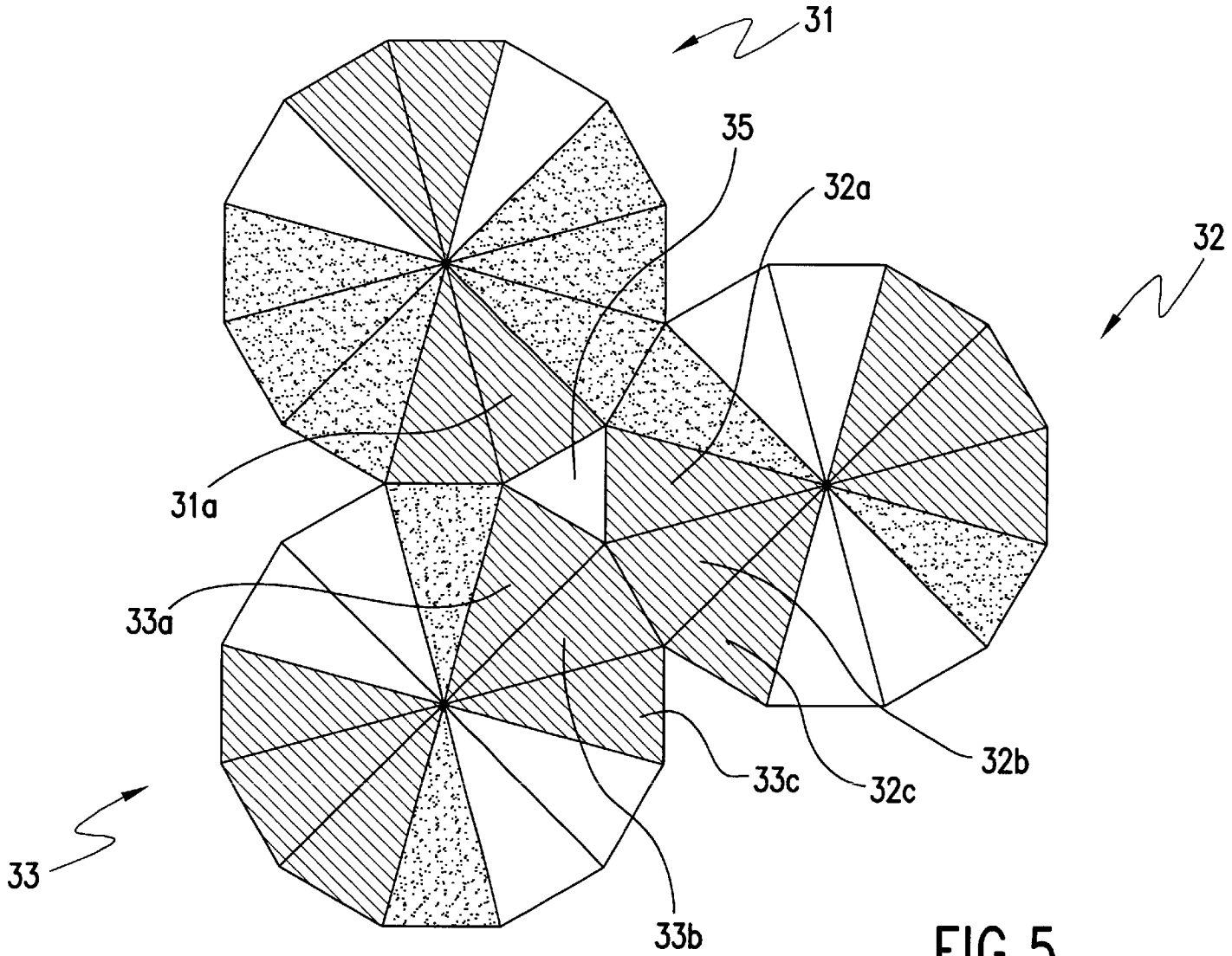
FIG. 5 shows three tiles enclosing an open area in accordance with an embodiment of the present invention.
Figure 6:
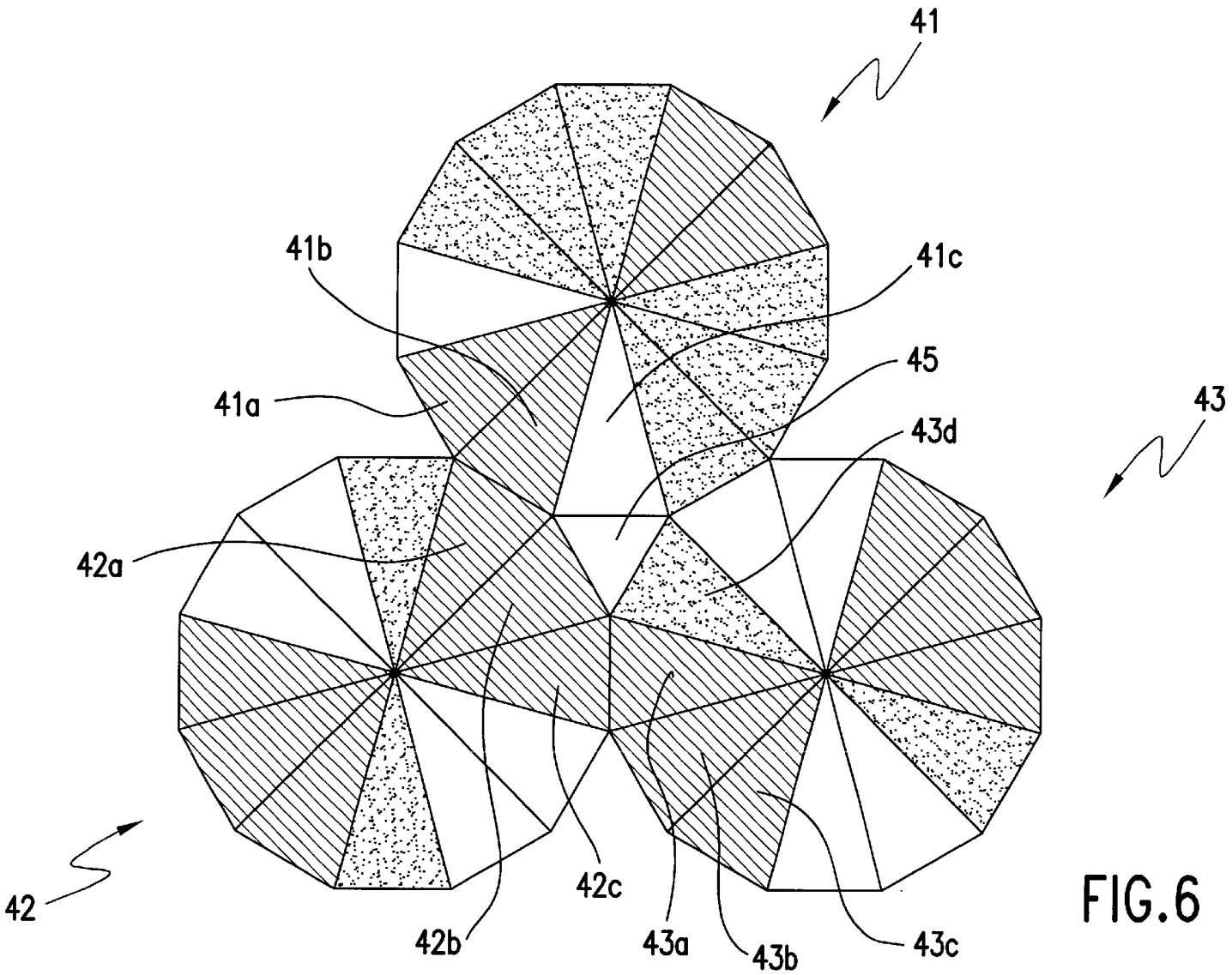
FIG. 6 presents another group of three tiles enclosing an open area in accordance with an embodiment of the present invention.

The enclosure scoring according to an embodiment of the present invention is illustrated in FIGS. 5 and 6. FIG. 5 presents the appearance of the tiles upon a third player having placed a tile 33 with two previously placed tiles 31, 32. The third player scores six points for the contiguous shaded area formed by subsections 32*a,* 32*b,* 32*c* on tile 32 and subsections 33*a,* 33*b,* 33*c* on tile 33. The third player also scores a "Dazzle" of ten points by enclosing an open area 35 with subsections of all the same shaded color. In FIG. 5, the open area 35 is enclosed by the shaded subsection 31*a* on tile 31, 32*a* on tile 32, and subsection 33*a* on tile 33. Thus, the third player in this play scores a total of sixteen points (six points for the contiguous sections and ten points for the Dazzle).

Similarly, FIG. 6 presents the scoring of an additional "Dazzle" for an enclosed area of three different colors. In FIG. 6, the third player has just placed a third tile 43 after the previous play of two tiles 41, 42. The placement of the third tile 43 scores eight points for the third player by virtue of the contiguous shaded area formed by subsections 41*a,* 41*b* on tile 41, subsections 42*a,* 42*b,* 42*c* on tile 42 and subsections 43*a,* 43*b,* 43*c* on tile 43. The third player also scores a "Dazzle" of ten points for the enclosed area 45, which is surrounded by subsections of all different colors—a white subsection 41*c* on tile 41, a shaded subsection 42*b* on tile 42, and a black subsection 43*d* on tile 43.

Figure 7:
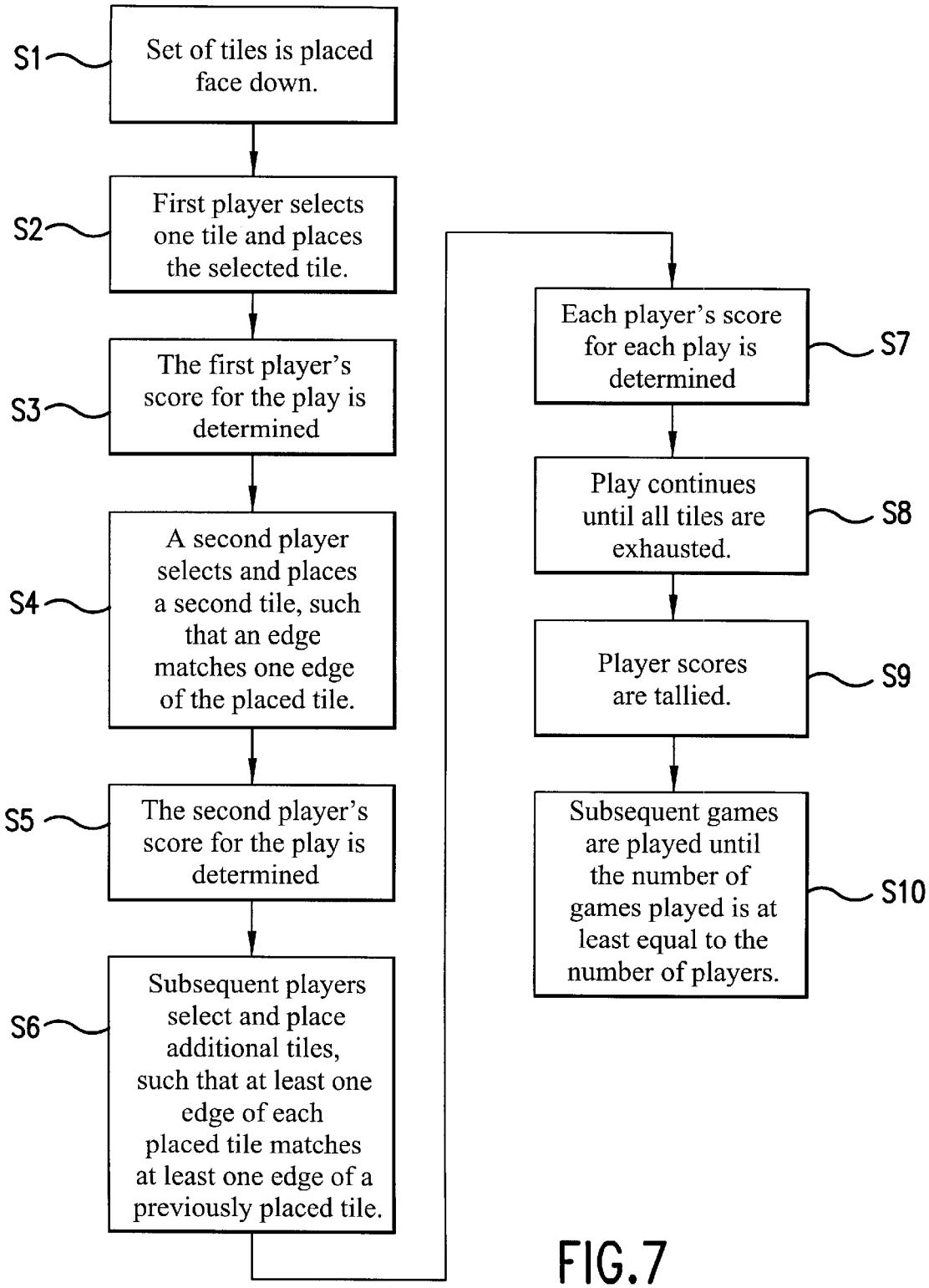
FIG. 7 is a flow diagram of the play of a game in accordance with an embodiment of the present invention.

FIG. 7 presents a flow chart of play of the game in accordance. with one embodiment of the present invention. In this embodiment, as shown in FIG. 7, in S1, the set of tiles is placed face down. In S2, the first player selects one tile and places the selected tile on the playing surface. In S3, the first player's score for the placement of the first tile is determined (note: score can be predetermined). In S4, a second player selects and places a second tile, such that an edge of the second placed tile matches an edge of the first placed tile. For example, the second tile is placed so that one of the colored subsections of the second tile matches one of the colored subsections of the first placed tile. In S5, the second player's score for the play is determined. Scoring for the second play includes, for example, counting the contiguous subsections of the two placed tiles.

In S6, subsequent players sequentially select and place additional tiles, so that at least one edge of each placed tile matches at least one edge of a previously placed tile. In S7, for each subsequent player's play, a score is determined for the placement of a tile. Scoring includes, for example, both the counted contiguous subsections formed by the placement of the tile, and scoring for enclosed open spaces in which either all of the edges have the same color or all of the edges are of differing colors.

In S8, play continues as in S6 and S7 until all tiles are exhausted. In S9, all player scores are tallied for the game. In one embodiment, in S10, subsequent games are played until the number of games played is at least equal to the number of players.

An embodiment of the present invention further includes a specialized playing surface for holding the twelve sided tiles in fixed placed positions. In an embodiment of the present invention, the surface includes indentations, in which tiles are placed when played. Section openings between groups of tiles, such as the three sided openings shown for three tile placements in FIGS. 5 and 6, are included within the playing surface. In an embodiment of the present invention, other openings, having more than three sides, are also included on the playing surface. In yet another embodiment, the playing surface includes only drawn or otherwise optically indicated (e.g., colored) placement positions for tiles.

An embodiment of the present invention further includes a time limit for play by each player. During each play by each player, in accordance with this embodiment, that player has a limited amount of time to play, such as one minute.

Another embodiment of the present invention includes a solitaire game for play by single player. In accordance with this embodiment, only selected tiles from the basic 30 tile set are used. For example, a set of 18 tiles is formed by selecting only the "bowtie" tiles. Bowtie tiles have two opposite single subsections of the same color. For example, in FIG. 4, tile 1 is a bowtie tile because of the opposite black single subsections. Tiles 10 and 15 are also black bowtie tiles. Each set of 30 tiles includes 18 bowties, leaving 12 nonbowties as a second subset.

Yet another subset for use in solitaire play are the tiles having adjacent sequential subsection groups of one, two, and three, which are referred to as "pinwheel" tiles. For example, in FIG. 4, tile 1 is a pinwheel having a single subsection group that is black, an adjacent (clockwise) two subsection group that is white, and a sequential (clockwise) three subsection group that is shaded. Tiles 10 and 15 are also pinwheels, with tile 10 having sequential (counterclockwise) groups that are black (one subsection), white (two subsections), and shaded (three subsections, and tile 15 having sequential (counterclockwise) groups that black (one subsection), shaded (two subsections), and white (three subsections). Twelve tiles in the 30 tile set are pinwheels.

According to another embodiment of the present invention, the subsets are usable for multiple player abbreviated games or to add additional difficulty to play.

Increased numbers of tiles sets may also be created by, for example, including two groups of subsections for each of the three tile colors, but not restricting the subsections for each of the two groups to the same number (e.g., a tile could include both a one section shaded group and a three section shaded group). Removing this restriction allows for 48 additional tiles to the 30 tiles of the base set.

Embodiments of the present invention have now been described in fulfillment of the above described advantages. It will be appreciated that these examples are merely illustrative of the invention. Many variations and modifications will be apparent to those skilled in the art.

What is claimed is:

1. A method for playing a game using plurality of tiles and a playing surface, each of the plurality of tiles having a plurality of edges, wherein each of the plurality of tiles is divisible into subsections, wherein each subsection includes one of the plurality of edges, wherein each tile includes three pairs of grouped subsections, each of the pairs of grouped sections including at least one subsection, the method comprising:

placing a first tile from the plurality of tiles onto the playing surface;

placing a second tile from the plurality of tiles onto the playing surface, wherein the second tile is placed such that one edge of the second tile is adjacent to one edge of the first tile, the one edge of the second tile matching the one edge of the first tile; and sequentially placing each of the remaining tiles from the plurality of tiles onto the playing surface, each of the remaining tiles being placed such that at least one edge of each of the remaining tiles as placed is adjacent to at least one edge of at least one of the placed tiles, and such that at least one of the at least one adjacent edge of each of the remaining tiles matches at least one adjacent edge of at least one of the placed tiles;

wherein each of the plurality of tiles is of a uniform shape, the shape including the plurality of sides; wherein the tiles are only placeable adjacent to one another.

2. The method of claim 1, further comprising providing a predetermined score for the placement of the first tile.

3. The method of claim 1, further comprising providing a score for each placed tile after the first tile, the score including a sum of contiguous matching edges on adjoining tiles, wherein the contiguous matching edges are contiguous with each placed tile upon placement of the tile.

4. The method of claim 3, wherein each subsection has a type, and wherein the score includes a sum of each contiguous subsection of the type of the matching at least one adjacent edge of each placed tile.

5. The method of claim 1, wherein the placed tiles are contiguous and form tiled areas and enclosed open areas on the playing surface, wherein the enclosed open areas are surrounded by the edges of the placed tiles, the method further comprising:

providing a score for each enclosed area wherein all of the edges of the placed tiles match.

6. The method of claim 5, wherein the enclosed open areas vary in size and shape.

7. The method of claim 5, herein the enclosed open areas have a shape, the shape being selected from a group of shapes, at least one of the group of shapes being a triangle.

8. The method of claim 1, wherein the placed tiles are contiguous and form tiled areas and enclosed open areas on the playing surface, wherein the enclosed open areas are surrounded by the edges of the placed tiles, the method further comprising:

providing a score for each enclosed area wherein each of the edges of the placed tiles differ.

9. The method of claim 1, wherein each of the plurality of tiles has twelve sides.

10. The method of claim 1, wherein each of the plurality of tiles has twelve subsections.

11. The method of claim 1, wherein the one edge of the second tile matching the one edge of the first tile comprises the one edge of the second tile and the one edge of the first tile having matching subsections.

12. The method of claim 1, wherein each of the plurality of subsections of each of the plurality of tiles has a surface of a single color.

13. The method of claim 12, wherein each edge of each of the plurality of tiles corresponds to one from the plurality of subsections of the tile, and wherein the one edge of the second tile matching the one edge of the first tile comprises the one edge of the second tile and the one edge of the first tile having corresponding subsection surfaces of the same color.

14. The method of claim 12 wherein each of the plurality of tiles includes at least one subsection of a first color, at least one subsection of a second color, and at least one subsection of a third color.

15. The method of claim 1, wherein the tiles are only placeable adjacent to one another via one of the at least one adjacent edge of each of the placed tiles.

16. The method of claim 1, wherein the playing surface comprises any flat surface.

17. A set of tiles for playing a tile game, wherein each tile of the set of tiles has a plurality of sides, wherein play of the game includes placement of a first tile on a playing surface and sequential placement of tiles on the playing surface, such that each sequentially placed tile is adjacent to at least one previously placed tile, and such that at least one side of each placed tile matches at least one side of at least one previously placed tile, the set of tiles comprising:

each tile including:

a twelve sided polygon shaped wafer having a center point; the wafer being divisible into twelve triangular subsections; wherein each triangular subsection is defined by one of the twelve sides and the center point; wherein each triangular subsection has a colored surface; and each colored surface having one of three colors, such that each tile is comprised of twelve colored surface subsections, at least one of the twelve colored surface subsections being a first color, at least one of the twelve colored surface subsections being a second color, and at least one of the twelve colored surface sections being a third color;

wherein each of the tiles is so formed such that when a first, a second, and a third tile are placed, such that a first side of the first tile abuts a first side of the second tile, a second side of the second tile abuts a first side of the third tile, and a second side of the third tile abuts a second side of the first tile, an opening must be enclosably formed by the first, second, and third tiles.

18. The set of tiles of claim 17, wherein each of the tiles is so formed such that when a first, a second, a third, and a fourth tile are placed, such that the first side of the first tile abuts the first side of the second tile, the second side of the second tile abuts the first side of the third tile, the second side of the third tile abuts a first side of a fourth tile, and a second side of the fourth tile abuts the second side of the first tile, an opening must be enclosably formed by the first, second, third, and fourth tiles.

19. A method for playing a game using a plurality of tiles, each of the plurality of tiles having a plurality of edges, wherein each of the plurality of tiles includes subsections, each subsection including one of the plurality of edges, each of the subsections having a type, the method comprising:

placing a first tile from the plurality of tiles onto a surface;

placing a second tile from the plurality of tiles onto the surface, wherein the second tile is placed such that one edge of the second tile is adjacent to one edge of the first tile, and wherein the one edge of the first tile is the same type as the one edge of the second tile; and sequentially placing each of the remaining tiles of the plurality of tiles onto the surface, each of the remaining tiles being placed such that at least one edge of the tile being placed is adjacent to an edge of a previously placed tile, wherein each of the at least one adjacent edge of the tile being placed is the same type as the adjacent edge of the placed tile.

* * * * *